United States Patent [19]

Break

[11] 4,081,986

[45] Apr. 4, 1978

[54] WIDE-RANGE SHEET MATERIAL BENDING BRAKE

[75] Inventor: Douglas G. Break, Farmington, Mich.

[73] Assignee: American Industrial Products, Inc., Livonia, Mich.

[21] Appl. No.: 754,735

[22] Filed: Dec. 27, 1976

[51] Int. Cl.[2] ..... B21D 5/04

[52] U.S. Cl. ..... 72/320

[58] Field of Search ..... 72/310, 319, 320

[56] References Cited

U.S. PATENT DOCUMENTS

| | | | |
|---|---|---|---|
| 1,131,055 | 3/1915 | Goeler | 72/319 |
| 1,131,055 | 3/1915 | Goeler | 72/319 |
| 1,549,090 | 8/1925 | Kelleher | 72/319 |
| 1,721,698 | 7/1929 | Krueger | 72/319 |
| 3,359,772 | 12/1967 | Fillip | 72/319 |
| 3,380,280 | 4/1968 | Wise | 72/319 |
| 3,383,899 | 5/1968 | Erco line | 72/319 |
| 3,482,427 | 12/1969 | Barnack | 72/319 |
| 3,914,974 | 10/1975 | DeVore | 72/319 |

*Primary Examiner*—Michael J. Keenan
*Attorney, Agent, or Firm*—Willis Bugbee

[57] ABSTRACT

To bend sheet metal through a wide angle into an acute angle, this bending brake has a foundation carrying a stationary workpiece-clamping structure including multiple J-shaped stationary workpiece-clamping jaw supports disposed in spaced parallel relationship and carrying an elongated stationary workpiece-clamping jaw. The upper portion of each such support terminates in a U-shaped cam thrust abutment engaged by an eccentric movable-jaw-operating cam operatively secured to a common composite cam shaft journaled in multiple movable workpiece-clamping jaw arms with downwardly-curved rearward end portions pivotally mounted at their rearward ends upon pivot bolts carried by the upwardly-curved rearward end portions of the stationary supports. Secured to and extending between the forward ends of these arms is a movable workpiece-clamping jaw of wedge-shaped cross-section and having a forward bending edge disposed immediately above the stationary workpiece-clamping jaw and also immediately above a so-called piano hinge which pivotally supports an elongated workpiece-bending structure movable upward and downward by one or more handles. Operatively connected to the composite cam shaft adjacent the stationary supports are the inner ends of handle arms disposed in spaced parallel relationship and connected at their outer ends to a common cam-operating handle bar which, when swung forward and rearward, rotates the cams against their respective thrust abutments to move the clamping arms upward and downward so as to move the movable clamping jaw toward and away from the stationary workpiece-clamping jaw.

4 Claims, 3 Drawing Figures

WIDE-RANGE SHEET MATERIAL BENDING BRAKE

SUMMARY OF THE INVENTION

Figure 1:
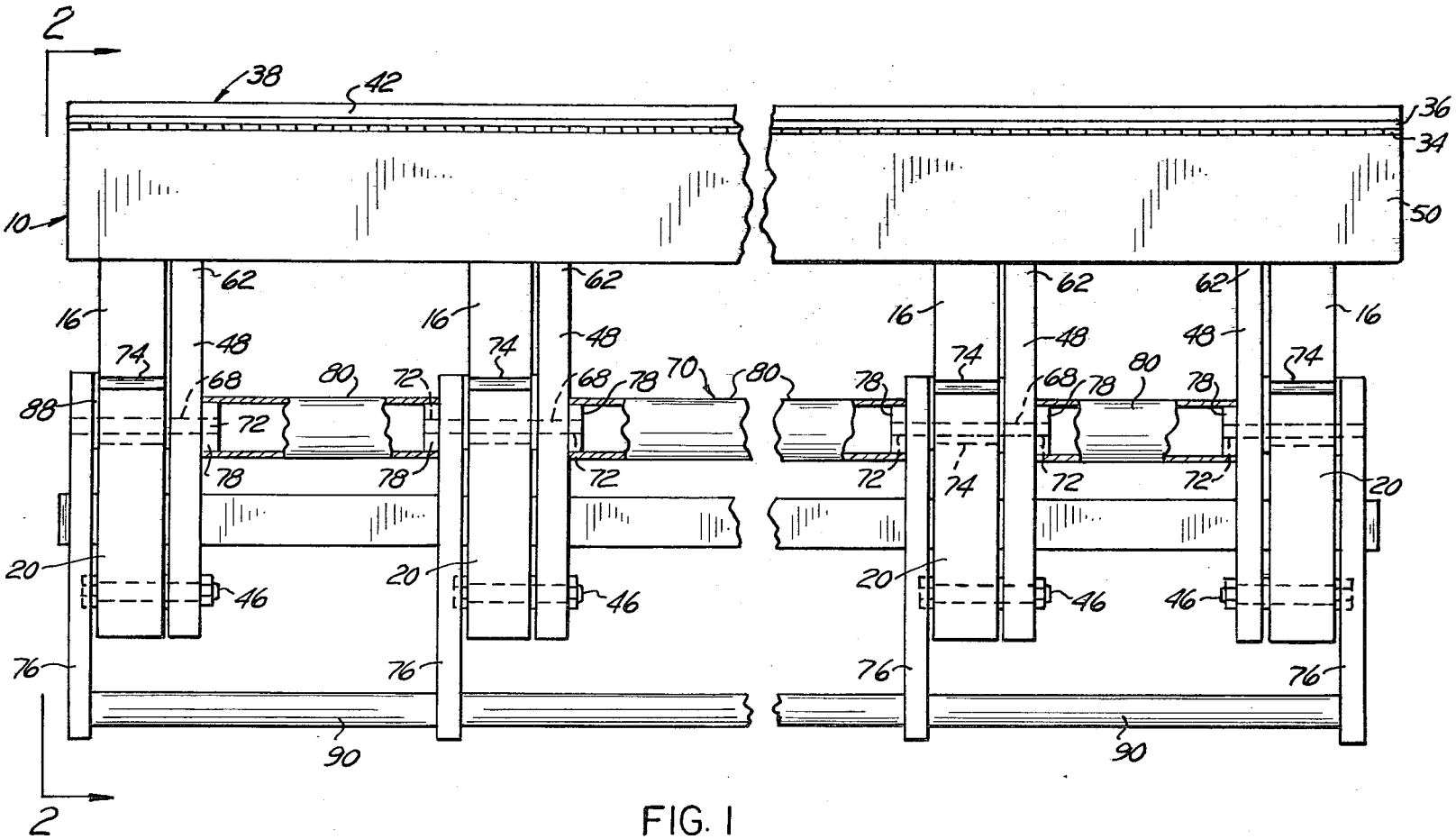

The invention particularly resides in the cam-operated clamping arrangement for sheet metal workpieces to be bent through a wide range of obtuse angles of swing against a wedge-shaped upper clamping jaw into a wide range of acute angles by a workpiece bending plate pivoted to the lower clamping jaw immediately below the fulcrum edge of the movable clamping jaw, also in the J-shaped supports and curved arms of the stationary and moveable jaw structures.

Figure 2:
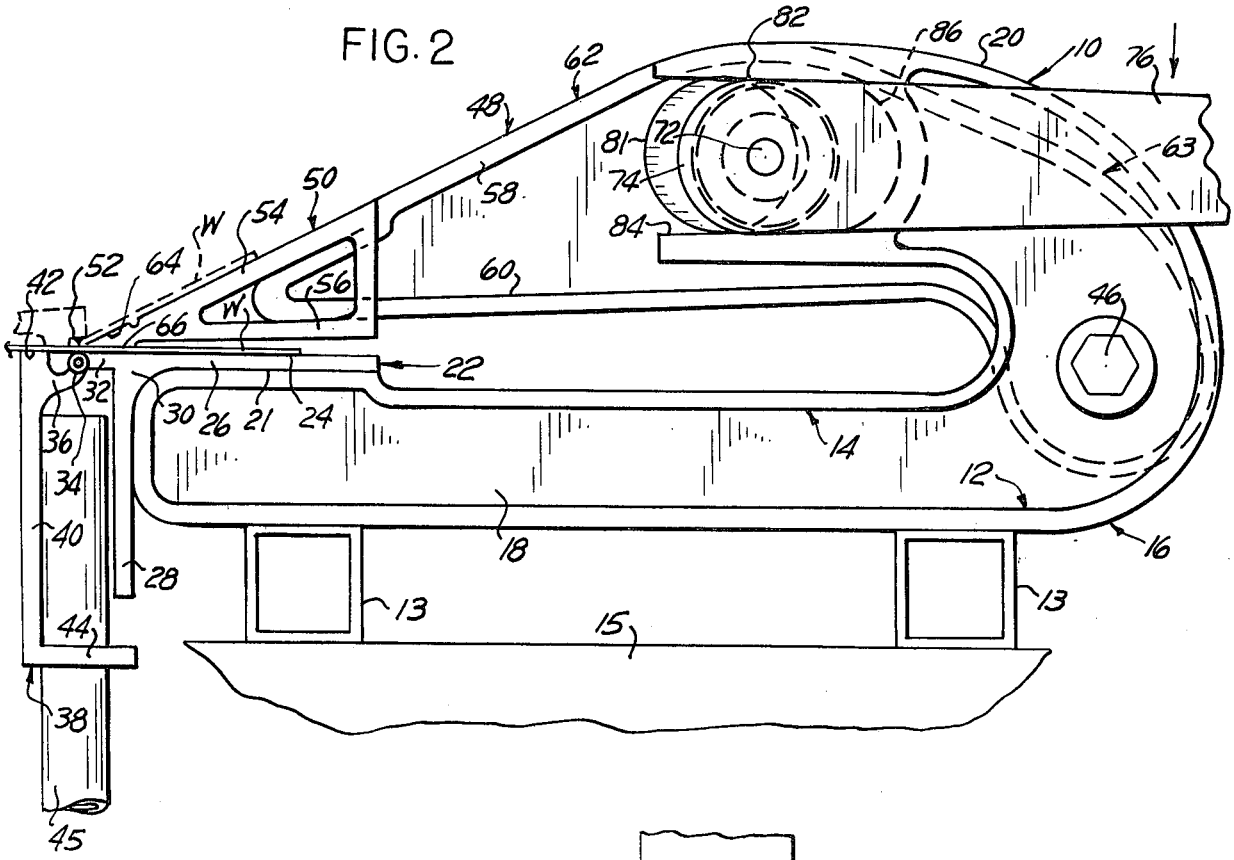
Figure 3:
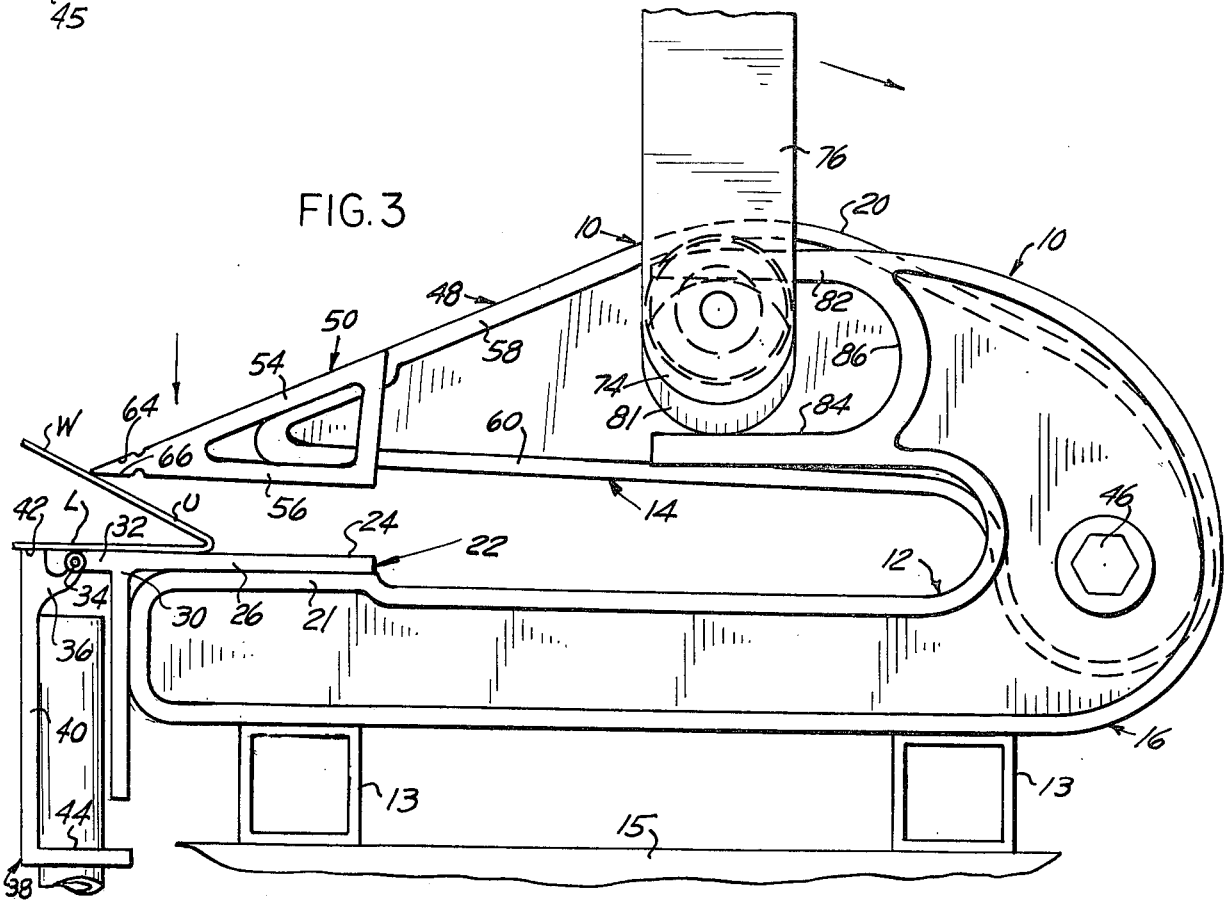

In the drawings,

FIG. 1 is a top plan view of a wide-range sheet material bending brake, according to one form of the invention, with the central portion broken away to conserve space and with the composite cam shaft broken away to more clearly disclose its construction;

FIG. 2 is an end elevation upon an enlarged scale, taken along the line 2——2 in FIG. 1, with the machine in its closed workpiece-clamping position before commencing the workpiece-bending operation, with the position of the bent portion and the bending plate shown in dotted lines; and FIG. 3 is a view similar to FIG. 2 but showing the bending brake in its open position with the bent workpiece reinserted between the jaws for further bending indicated by the left-hand arrow, in response to the swinging of the cam handle arms in the direction of the right-hand arrow.

Referring to the drawings in detail, FIGS. 1, 2, and 3 show a wide-range sheet material bending brake, generally designated 10, composed generally of stationary and movable workpiece-clamping jaw structures 12 and 14 pivoted to one another and supported upon spaced parallel hollow beams 13 which in turn rest upon a suitable foundation or base 15. The bending brake 10 contains multiple J-shaped stationary workpiece-clamping jaw supports 16 in the form of castings disposed in spaced parallel relationship along the parallel hollow beams 13. Each such support has forwardly-extending lower and upper portions 18 and 20, the forward end of the former of which has a flat horizontal surface 21 upon which is mounted an elongated stationary lower workpiece-clamping jaw 22 which extends between all of the multiple lower brackets or supports 16 for supporting an elongated workpiece W of sheet material, such as sheet metal, to be bent. The stationary lower jaw 22 has a horizontal flat upper surface 24 and is of approximately T-shaped cross-section with horizontal and vertical plate portions 26 and 28 respectively meeting at a common junction 30 from which a flange 32 projects a short distance outward for the mounting of the stationary portion of a so-called piano hinge 34, the movable portion of which is mounted upon the upper flange 36 of an approximately L-shaped movable workpiece bending structure, generally designated 38.

The movable workpiece bending structure 38, in addition to the arm portions 36, has a web portion 40 terminating at its upper end in a flat narrow bending face 42 projecting upward from the arm portions 36 and forming the upper edge of the web portion 42, the lower edge of which terminates in an inwardly-extending horizontal lower flange 44. Operatively secured to the movable workpiece bending structure 38 are spaced handles 45, only one being shown. The piano hinge 34 and the workpiece bending structure 38 extend between and interconnect all of the jaw brackets or supports 16 (FIG. 1). The handles 45 are preferably connected to a common handle bar (not shown) similar to the handle bar described below and shown at 90 in FIG. 1.

The J-shaped stationary jaw supports 16, at the junctions of their lower and upper portions 18 and 20, are bored coaxially to receive pivot bolts 46 upon which are pivotally mounted the similarly bored rearward end portions of movable clamping jaw arms 48 (FIG. 1). Mounted on and secured to the forward end portions of these arms 48, which are likewise of approximately J-shaped form, is a movable upper workpiece-clamping jaw 50 of wedge-shaped cross-section terminating in a forward bending or fulcrum edge 52 and composed of upper and lower portions 54 and 56 respectively engaging the correspondingly-inclined upper and lower portions 58 and 60 of the forward portions 62 of the arms 48, which have rearward portions 63. The upper workpiece-clamping jaw 50 extends entirely across and is secured to the forward end portions of the arms 48 (FIG. 1) in the same manner as the lower work-clamping jaws 22 extend entirely across and are secured to the forward portion 18 of the stationary jaw supports 16. The movable upper workpiece-clamping jaw 50 adjacent its forward edge 52 has upper and lower surfaces 64 and 66 which make contact with the initially upper surface of the sheet material workpiece W to be bent. The arms 48 are also conveniently made in the form of castings.

The rearward portions 63 of the movable clamping jaw arms 48 are curved downwardly and rearwardly toward the bores which accommodate the pivot bolts 46. At approximately the junctions of the forward and rearward portions 62 and 63, the arms 48 are bored coaxially at 68 and are connected to a composite cam shaft 70. The composite cam shaft 70 consists of axially-spaced reduced diameter solid shaft portions 72 which pass through the coaxially-bored arms 48 and likewise through eccentric cams 74 and lever arms 76 (FIG. 1). The ends of each solid shaft portion 72 are secured to coaxially-bored collars or discs 78, the peripheries of which are secured within the opposite ends of spacing and driving tubes 80 of the composite cam shaft 70. The cams 74 (FIGS. 2 and 3) have circular peripheries 81 and are mounted between the parallel upper and lower bearing surfaces 82 and 84 respectively of a U-shaped recess 86 in the forward ends of the upper portions 20 of the J-shaped stationary workpiece-clamping jaw supports 16. Thrust washers or thrust bearings 88 are mounted between the brackets 16 and the arms 48 and between the cams 74 and arms 76. The outer ends of the lever arms 76 are likewise bored coaxially and receive a common handle bar 90 (FIG. 1).

In the operation of the wide-range bending brake 10, due to the driving connections between the handle bar 90 and the lever arms 76 and the driving connections between the latter and the solid shaft portions 72 and cams 74, the raising of the handle bar 90 and lever arms 76 from the positions shown in FIGS. 1 and 2 to the positions shown in FIG. 3 rotates the composite shaft 70 and consequently rotates its component solid shaft portion 72 and cams 74. As a result, the rotation of the circular peripheries 81 of the eccentric cams 74 between the parallel bearing surfaces 82 and 84 of the stationary J-shaped supports 16 causes the movable clamping jaw arms 48 to rise (FIG. 3) and consequently to open up the space between the upper and lower clamping jaws 50 and 22 for the insertion of the sheet material workpiece W.

With the bending brake 10 in its open position (FIG. 3), the flat sheet of metal or other material constituting the workpiece W is inserted between the upper and lower clamping jaws 50 and 22, with the desired location of the bending line placed in coincidence with the fulcrum edge 52 of the upper clamping jaw 50. The operator then pushes the handle bar 90 downward and rearward in a clockwise direction from the position of FIG. 3 to the position of FIG. 2, thereby closing the upper clamping jaw 50 upon the workpiece W resting upon the upper surface 24 of the lower clamping jaw 22.

With the workpiece W thus clamped between the upper and lower clamping jaws 50 and 22, the operator now swings the bending handle bar (not shown) of handles 45 upward in a clockwise direction around the piano hinge 34, thereby swinging the movable workpiece bending structure 38 upward clockwise in a similar manner around the piano hinge 34. This action causes the bending face 42 to bend the forward portion of the workpiece W upward in a clockwise direction around the fulcrum edge 52 which, being immediately above the piano hinge 34 and separated from it only by the thickness of the workpiece sheet W, serves to bring about bending of the workpiece W along exactly the desired bending line without relative sliding between the workpiece W and the bending face 42 during the bending operation.

The workpiece bending structure 38 is swung upward in a clockwise direction around the fulcrum edge 52 of the upper clamping jaw 50 until the desired angle is achieved between the two portions of the workpiece W up to a limiting angle determined by the angle between the upper and lower surfaces 64 and 66 of the movable clamping jaw 50. If further bending is desired, the bending brake 10 is opened in the above-described manner by swinging the handle bar 90 and arms 76 upward into a vertical position (FIG. 3) where it is replaced in the position shown in FIG. 3. The handle bar 90 and arms 76 are then swung downward in a clockwise direction toward the position shown in FIG. 2 until the desired acute angular relationship is achieved between the upper and lower portions U and L respectively of the workpiece W. If the two portions U and L are to be bolted through an angle of 180°, the upper clamping jaw 50 is moved downward as far as possible so that its lower surface 66 is separated from the upper surface 24 of the lower clamping jaw 22 solely by the combined thicknesses of the upper and lower portions U and L of the workpiece W.

The sheet material bending brake of the present invention has the following advantages over prior bending brakes:

1. Its provision of cams for closing the workpiece clamping jaws gives a much more powerful gripping action than the previously-used wedges for so doing.

2. The cam-operating handle bar and its cam-operating lever arms swing into out-of-the-way rearward lowered positions when the workpiece clamping jaws are in their clamping positions, thereby freeing the space above the machine for the upward and rearward swinging of the portion of the workpiece being bent, while this construction, in combination with the small acute angle between the lower and upper surfaces of the upper workpiece clamping jaw, for example 30°, enables the bending bending of the sheet material workpiece through a more obtuse angle of bend into a more acute included angle between the opposite surfaces than has hitherto been accomplished in a single machine by a single bending operation.

3. The above-described construction eliminates the need for using a supplementary bending brake attachment to increase the obtuse bending angle, such as provided by my previous U.S. Pat. No. 3,913,370 issued Oct. 21, 1975, for Supplemental Bending Attachment for Portable Sheet Material Bending Brake.

4. If it is desired to bend the workpiece to a more acute angle than the 30° angle provided by the 150° bend of the present machine, or to double fold the workpiece by a 180° bend, this can be accomplished by reinserting the bent workpiece into the machine after the first fold has been accomplished, as shown in FIG. 3, and then performing a second bending operation in the present machine, thereby eliminating the need for a supplemental bending attachment just mentioned.

5. Because of the open-ended construction of the bending brake of the present invention, sheet material workpieces can be inserted and removed from either end of the machine.

I claim:

1. A wide-range sheet material bending brake, comprising a stationary workpiece-claping structure including a plurality of stationary elongated clamping jaw supports disposed in laterally-spaced aligned relationship, said stationary workpiece clamping jaw supports having forward and rearward end portions, said stationary workpiece-clamping structure having a stationary workpiece-clamping jaw mounted on and extending between said stationary forward end portions in interconnecting relationship therewith, a movable workpiece-clamping structure including a plurality of movable elongated-clamping jaw arms disposed in laterally-spaced aligned relationship, said movable workpiece-clamping jaw arms having forward and rearward end portions, said movable workpiece-clamping structure having a workpiece-clamping jaw mounted on and extending between said movable forward end portions in interconnecting relationship therewith, said movable workpiece-clamping jaw having a forward workpiece-bending edge, said stationary workpiece-clamping jaw having a forward edge with hinge means thereon disposed below said workpiece-bending edge with the pivot of said hinge means disposed in substantially vertical alignment with said workpiece-bending edge, said stationary workpiece-clamping jaw supports being approximately J-shaped with substantially horizontal forward portions and with upstanding arcuate rearward portions, said rearward end portions of said movable workpiece-clamping jaw arms being of downwardly and rearwardly extending arcuate configuration.

2. A wide-range sheet material bending brake, comprising a stationary workpiece-clamping structure including a plurality of stationary elongated clamping jaw supports disposed in laterally-spaced aligned relationship, said stationary workpiece clamping jaw supports having forward and rearward end portions, said stationary workpiece-clamping structure having a stationary workpiece-clamping jaw mounted on and extending between said stationary forward end portions in interconnecting relationship therewith, a movable workpiece-clamping structure including a plurality of movable elongated workpiece-clamping jaw arms disposed in laterally-spaced aligned relationship, said movable workpiece-clamping jaw arms having forward and rearward end portions, said movable workpiece-clamping structure having a workpiece clamping jaw mounted on and extending between said movable forward end portions in interconnecting relationship therewith, said movable workpiece-clamping jaw having a forward workpiece-bending edge, said stationary workpiece-clamping jaw having a forward edge with hinge means thereon disposed below said workpiece-bending edge with the pivot of said hinge means disposed in substantially vertical alignment with said workpiece-bending edge, one of said clamping structures having cam thrust abutment means thereon and the other of said clamping structures having rotary cam means thereon operatively engageable with said cam thrust abutment means and responsive to the rotation of said cam means in opposite directions for urging said movable workpiece-clamping jaw toward and away from said stationary workpiece-clamping jaw into and out of clamping engagement with a sheet material workpiece disposed between said workpiece-clamping jaws, said cam thrust abutment means being disposed between said forward and rearward end portions of said one clamping structure, and said rotary cam means being disposed between said forward and rearward end portions of said other clamping structure, said cam thrust abutment means comprising paired cam thrust portions disposed in spaced parallel relationship with connecting portions extending therebetween, said cam means comprising a cam shaft rotatably mounted and journaled in one of said clamping structures and also including eccentric cams drivingly secured in said cam shaft in axially-spaced relationship, each of said cams being disposed within one of said paired cam thrust portions.

3. A wide-range sheet material bending brake, according to claim 1, wherein pivot means are disposed within said arcuate rearward portions, and wherein cam thrust abutment means are disposed adjacent the upper ends of said arcuate rearward portions.

4. A wide-range sheet material bending brake, according to claim 2, wherein cam-operating handle means are operatively connected to said rotary cam means and extend rearwardly therefrom away from said workpiece clamping jaws in the workpiece-clamping position of said clamping jaws.

* * * * *